United States Patent [19]

Keller et al.

[11] Patent Number: 5,063,758

[45] Date of Patent: Nov. 12, 1991

[54] APPARATUS FOR APPLYING A TREATMENT FLUID HAVING PIVOTAL NOZZLE COMBS

[75] Inventors: Alfred Keller, Willich; Julius Kohnen, Tönisvorst; Wolfgang Kurschatke, Krefeld, all of Fed. Rep. of Germany

[73] Assignee: Eduard Küsters Maschinenfabrik GmbH & Co., Krefeld, Fed. Rep. of Germany

[21] Appl. No.: 524,355

[22] Filed: May 16, 1990

[30] Foreign Application Priority Data

May 16, 1989 [DE] Fed. Rep. of Germany ..... 3915844

[51] Int. Cl.[5] ..... D06B 1/06

[52] U.S. Cl. ..... 68/205 R; 118/325

[58] Field of Search ..... 68/200, 205 R; 118/324, 118/325

[56] References Cited

U.S. PATENT DOCUMENTS 2,218,811 10/1940 Chaussabel .
4,254,644 3/1981 Bartlett et al. ..... 68/205 R
4,377,080 3/1983 Fox ..... 68/205 R
4,547,421 10/1985 Otting et al. ..... 68/205 R

FOREIGN PATENT DOCUMENTS 57830 8/1982 European Pat. Off. .
1289239 9/1972 United Kingdom .
1363724 8/1974 United Kingdom .
2052312 1/1981 United Kingdom .

*Primary Examiner*—Philip R. Coe
*Attorney, Agent, or Firm*—Kenyon & Kenyon

[57] ABSTRACT

An apparatus for applying a treatment fluid, such as dye, onto an advancing web of material has a run-off surface sloping down toward the web that extends above and over the width of the web. The dye flows onto the web from the lower edge of the run-off surface. The dye is applied onto an upper zone of the run-off surface from individual nozzles, which are a constituent part of nozzle combs that are pivotable about a transverse axis between a first position disposed above the run-off surface and a second position over a run-off gutter.

15 Claims, 4 Drawing Sheets

APPARATUS FOR APPLYING A TREATMENT FLUID HAVING PIVOTAL NOZZLE COMBS

BACKGROUND OF THE INVENTION

The invention relates generally to an apparatus having a plurality of tine-like nozzles resembling the teeth of a comb for applying a treatment fluid, such as a dye, onto a web of material, such as a textile material, and, more particularly, to such a fluid treatment apparatus in which the nozzles are mounted for movement between a first position in which treatment fluid is directed from the nozzles onto a run-off surface of the apparatus and a second position in which the fluid is directed away from the run-off surface.

Fluid treatment apparatus of the general type discussed above is disclosed in U.K. Patent 1,363,724 and European patent document 19035. In the apparatus disclosed in these documents, a flat rectangular run-off surface is arranged above, and across the width of, the material to be treated The run-off surface slopes down to the material and has a lower horizontal edge situated directly above the material The apparatus includes nozzles distributed across the width of the web, which terminate above the upper portion of the runoff surface. A treatment fluid can be applied from the nozzles onto the upper zone of the run-off surface. These apparatus are used to create patterns on fabrics by applying various treatment fluids from the nozzles onto the run-off surface. The fluids mix on the run-off surface and, as a mixture, are conducted in a veil from the horizontal lower edge of the run-off surface onto the fabric therebelow running through the apparatus. The main objective in the apparatus disclosed in these documents is the irregular mixing of the applied treatment fluids, which leads to a random, non-repeating pattern on the material to be treated, generally a textile web.

A problem with these types of apparatus is the inability to achieve a sufficiently precise start of the application of treatment fluid and, respectively, an equally precise end thereof. When the valves associated with the outlet nozzles close, a small amount of treatment fluid still drips from the nozzles. Also when the valves first open, the nozzles must first go through a certain preliminary start-up phase before stationary conditions are reached. Thus, one of the problems to which the invention is directed is to more precisely define the beginning and end of the application of the treatment fluid in apparatus of the general type described above.

SUMMARY OF THE INVENTION

The invention solves this problem by providing apparatus for applying a treatment fluid onto a web of material in which a run-off member is connected to a support structure of the apparatus in a position allowing a web of material to be treated in the apparatus to pass underneath the run-off member. The run-off member has upper and lower horizontal edges extending transverse to a web to be treated by the apparatus. These edges define ends of a substantially flat, rectangular run-off surface having an upper and lower portion. The run-off surface slopes downwardly such that the lower horizontal edge is situated directly above a web to be treated by the apparatus when such a web passes underneath the runoff member. A plurality of nozzles are distributed in a direction transverse to a web to be treated by the apparatus. The nozzles are carried by the support structure so as to be located in a first position above the upper portion of the run-off surface whereby treatment fluid conducted to the nozzles can be applied onto the upper portion of the run-off surface. Means are provided for supporting at least one of the nozzles for movement away from the run-off surface to a second position in which treatment fluid conducted to the nozzle is sprayed away from the run-off surface.

By moving the nozzles away from the run-off surface, the feed of treatment fluid onto the run-off surface is stopped abruptly, while when the nozzles are moved to a position over the run-off surface treatment fluid again is applied onto the upper zone of the run-off surface just as abruptly, and from there flows onto the web. The movement of the nozzle can be obtained by providing means supporting the nozzle for pivotal movement about an axis extending above the nozzle in a direction transverse to the web.

A run-off gutter extending adjacent and parallel to the upper edge of the run-off surface may be provided to collect and conduct the treatment fluid that continues to be directed from the movable nozzles as they are moved away from and over the upper edge of the run-off surface. Likewise, the gutter collects treatment fluid sprayed from the nozzles when the nozzles are disposed outside the run-off surface during initial start-up of the apparatus before steady state conditions at the nozzles are established.

The beneficial effects of the invention may be achieved if at least one of the nozzles is movable in the above-stated manner. However, in practice, generally all of the nozzles distributed over the width of the web will be movable. In that case, at least two groups of nozzles may be provided, which are supported for movement away from the run-off surface independent of each other. The nozzles of one group may alternate in the transverse direction with nozzles of an additional group. The alternation of the nozzles need not occur such that after a nozzle of one group, viewed in transverse direction of the web, there always follows exactly one nozzle of another group. Rather, it is also possible that, for example, two or more nozzles of another group may follow. Also, more than two groups of alternating nozzles may be provided. In practice, however, the individuals groups of nozzles should be uniformly distributed over the width of a web to be treated. The nozzles or groups of nozzles also may be supplied separately with treatment fluid. In particular, the nozzles of one group may be supplied separately from the nozzles of the other group. Separate supply of treatment fluid is disclosed, per se, in U.K. Patent 1,363,724 and European patent document 19035.

An especially advantageous pivotable nozzle arrangement of the invention is achieved when each group of nozzles comprises a pivotable nozzle comb formed by an elongate support member having a longitudinal axis extending in a direction transverse to a web to be treated in the apparatus, and a plurality of comb tines downwardly depend from the elongate support member at spaced intervals along the length of the support member. Each tine has a free end distal from the support member upon which one of the plurality of nozzles is mounted. The supporting means may comprise a bearing provided for each nozzle comb that is coupled between the elongate support member and the support structure. The bearing has a pivot axis extending above the elongate support member in a direction transverse to a web to be treated in the apparatus. When the nozzles of the individual groups are evenly distributed over the width of the web and when one or more groups are movable between the first and second positions, the nozzle combs are arranged such that the comb tines of each group pass through the tines of another group unhindered during pivotal movement of the nozzle combs.

The treatment fluid conducted to each nozzle or to groups of nozzles may be controlled by a separately controllable valve fixedly supported in the apparatus in a position above the nozzles and connected to its associated nozzle or groups of nozzles by flexible conduits. Not only does this arrangement present an advantageous structural design because the nozzles and feed lines are fixedly installed, but it also advantageously reduces the amount of mass that must be moved when pivoting the nozzles.

It has been found that for the application of, for example, dyes on carpets, where relatively large quantities of liquid per square meter of carpet surface may be applied, the simplest type of valve design is the best. Therefore, use of squeezed tube valves to control the nozzle flow is especially advantageous in this particular application. With this type of valve, a large cross section can be opened and closed by simple means without danger of clogging.

The nozzles of the invention apply jets of treatment fluid onto the run-off surface at individual points. The jets of treatment fluid merge on the run-off surface as a cohering film, but the irregularities remaining in the film thickness due to the flow conditions may not be acceptable in some cases. In such cases, a flow homogenizing baffle extending over the width of the run-off surface may be provided. The baffle detains the flowing treatment fluid and releases it again at a plurality of discharge points, which exceed the number of nozzles by a multiple and, hence, are spaced closer together than the nozzles. This facilitates the merging of the jets to a film, while waves or irregularities in the thickness of the outflowing film, which would otherwise cause an irregular application of treatment fluid over the width of the web to be treated, are prevented.

The invention is not limited to the treatment of web-type material. The term "web of material" as used herein and in the appended claims includes not only a single piece of material, but also individual pieces of material that may be conducted through the fluid treatment apparatus of the invention, e.g., by a conveyor belt disposed under the apparatus. The individual pieces are not required to be flat or of uniform height, but may be workpieces of different height.

Further features, advantages, and embodiments of the invention are apparent from consideration of the following detailed description, drawings and appended claims.

DETAILED DESCRIPTION

Figure 1:
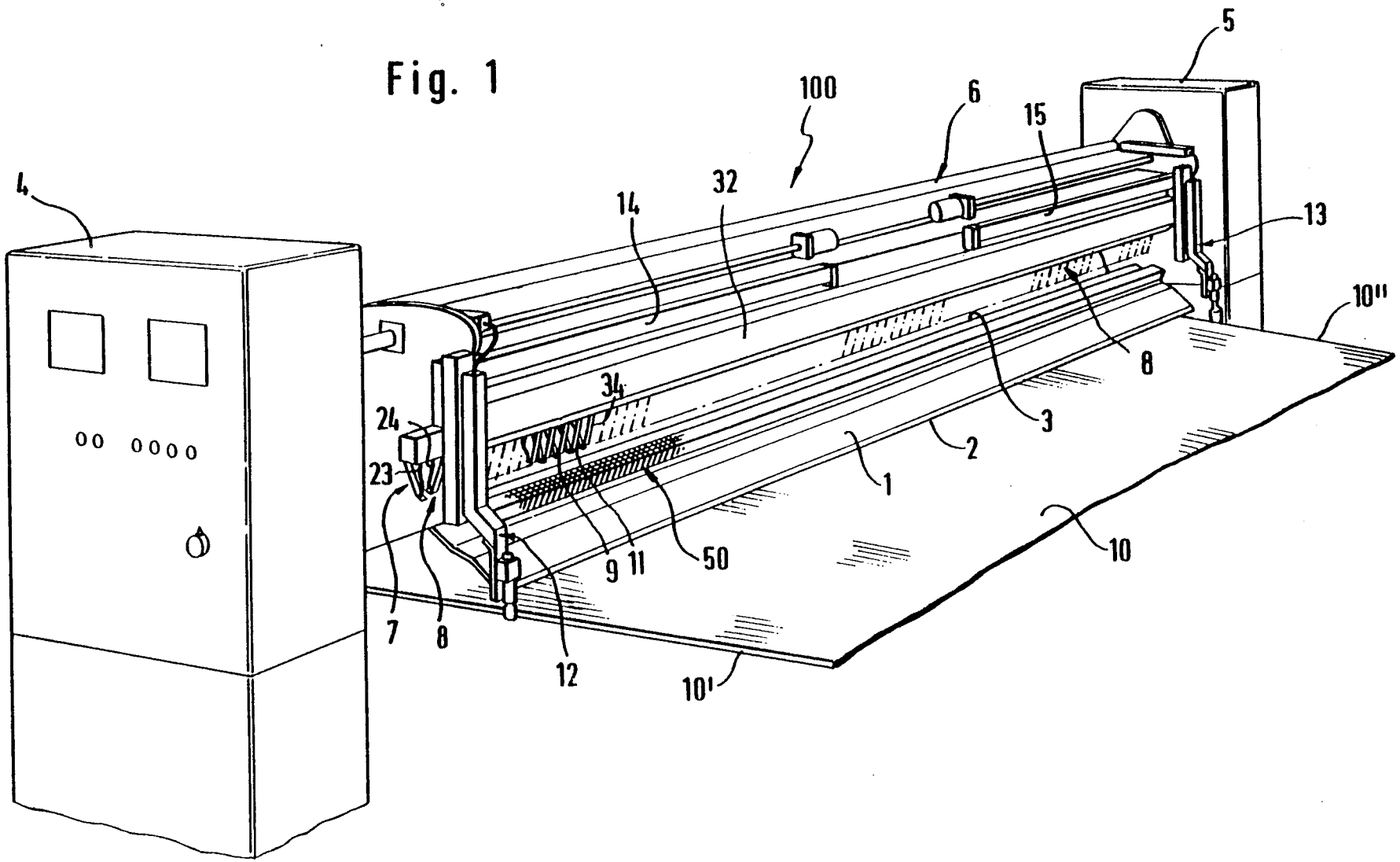
FIG. 1 is an overall perspective view of a fluid treatment applying apparatus constructed according to the principles of the invention.
Figure 4:
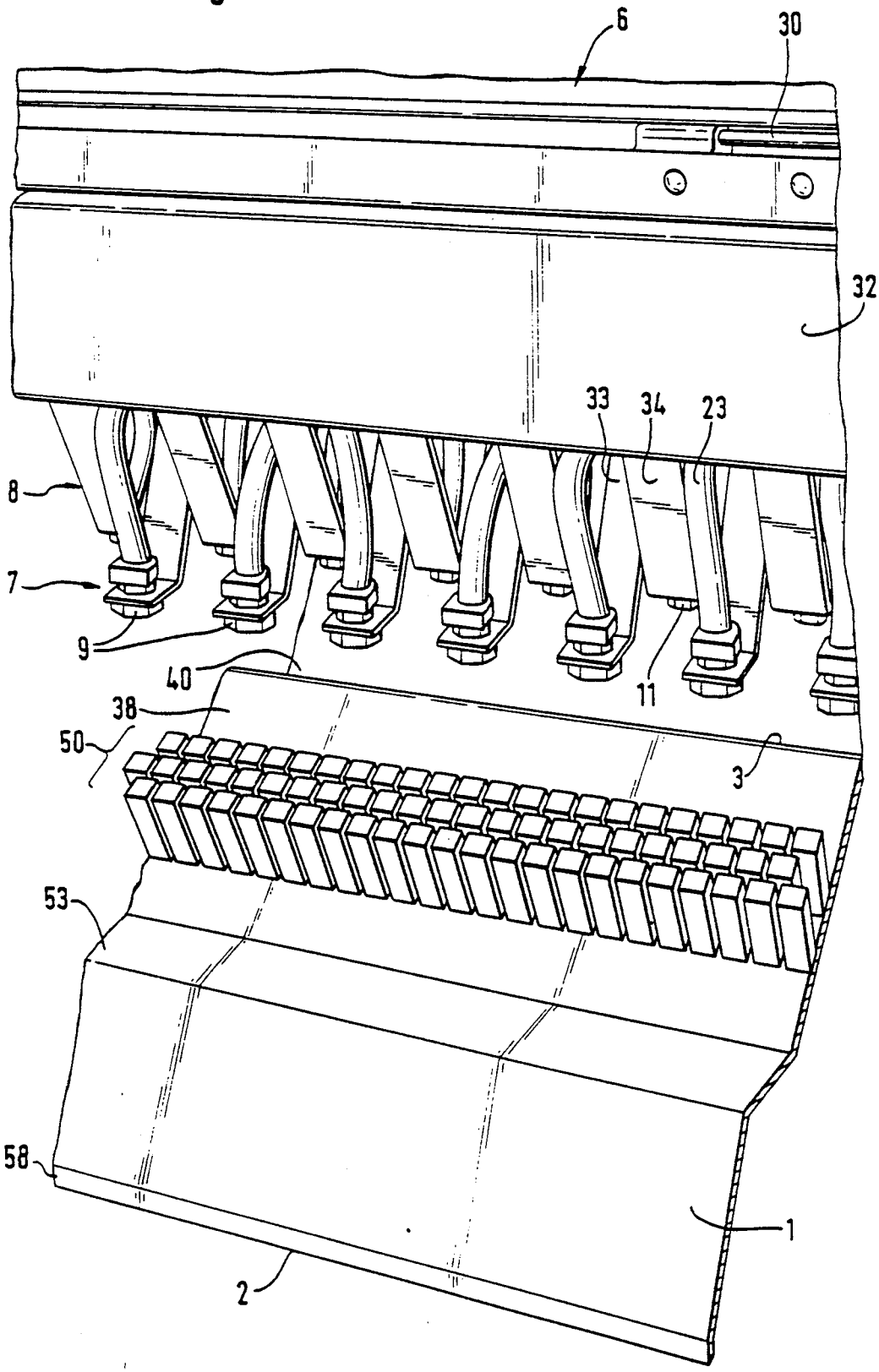
FIG. 4 is a partial perspective front view of the nozzle combs of the invention.

The apparatus 100 shown in FIG. 1 is used to apply a treatment fluid, such as a dye, to a carpet web 10, which is conducted horizontally through the apparatus 100. The apparatus 100 includes an obliquely positioned run-off surface 1 in the form of a narrow rectangle whose longer sides extend transverse to the web 10. The run-off surface 1 is formed from an angularly bent plate, having a substantially flat upper region, which assumes an angle of about 30° relative to the horizontal. Run-off surface 1 slopes obliquely down toward the fabric web 10 such that its lower edge 2 lies just above the fabric web 10. The upper edge 3 of surface 1 is shown in FIGS. 1 and 4.

The run-off surface 1 is carried by two lateral standards 4, 5 of the apparatus 100, which also contain the control devices for the apparatus. Spaced above the run-off surface 1, a horizontal supporting structure 6 extends transverse to the fabric web 10. On the underside of structure 6, nozzle combs 7, 8, which are described in more detail subsequently, are pivotally mounted at their upper or back sides about an axis extending transverse above the web 10. At the downwardly directed free ends of the "comb tines" of nozzle combs 7, 8, nozzles 9, 11 (FIG. 4) are provided for directing fluid dye onto the run-off surface. In one pivoted position of the nozzle combs 7, 8, nozzles 9, 11 are positioned above the upper zone 38 of the run-off surface 1 such that the fluid dye flowing from the nozzles falls onto upper zone 38 and down onto the web 10 via the oblique run-off surface 1 and the lower edge 2 thereof. In another pivoted position, the nozzles 9, 11 are placed over a run-off gutter 40 provided behind the upper edge 3 of the run-off surface 1. The gutter collects fluid dye flowing from the nozzles 9, 11 and conducts it away from the web 10.

The longitudinal edges 10', 10'' of web 10, which extend parallel to the running direction of the web, are scanned by edge sensors 12, 13, which are movable on tracks 14, 15 of the support structure 6 to follow the edges 10', 10''. In this manner, the nozzles 9, 11 located outside the edges 10', 10'' of web 1 may be turned off.

Figure 2:
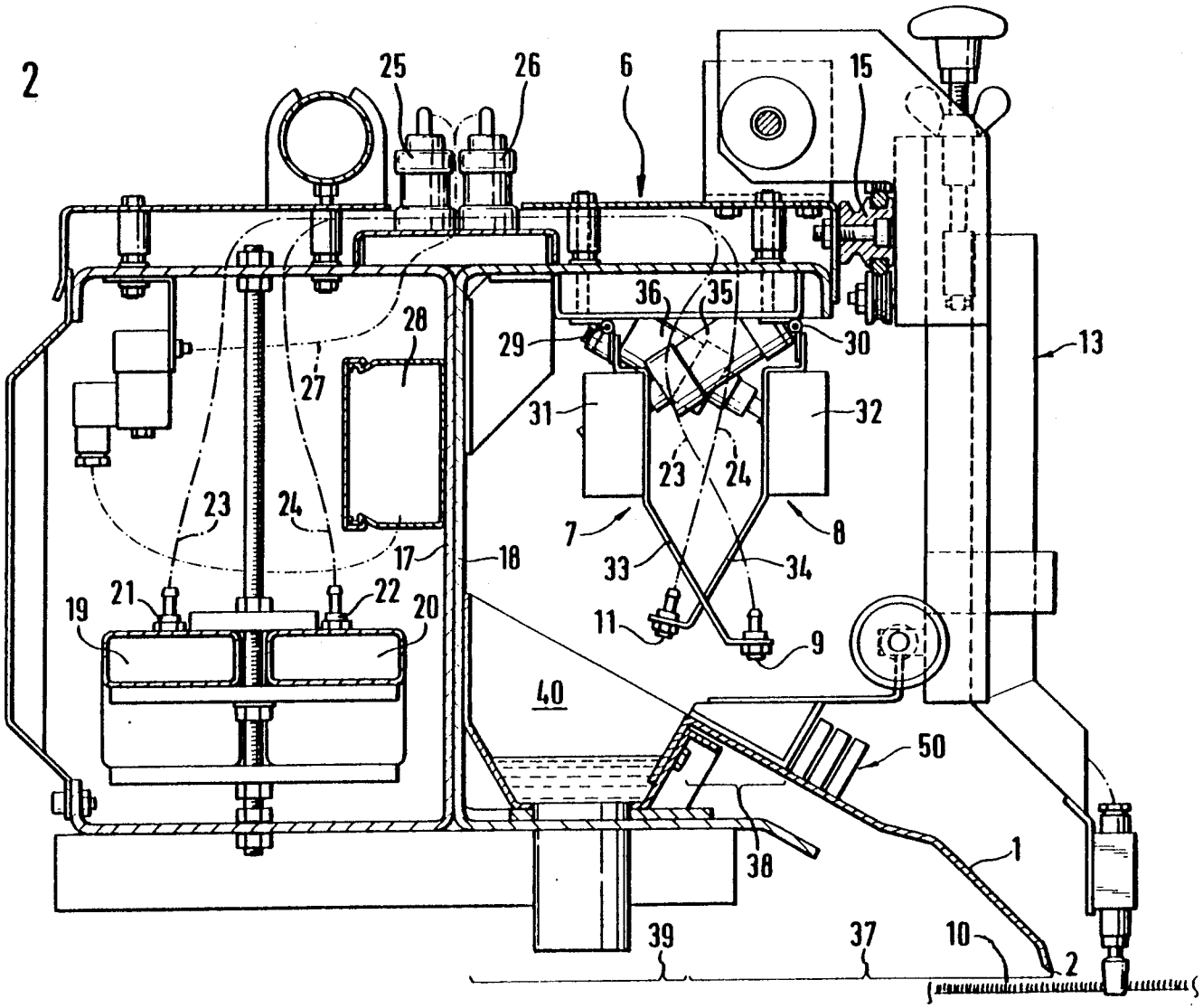
FIG. 2 is a transverse cross-sectional view of the fluid treatment applying apparatus of the invention taken along a longitudinal plane perpendicular to the web.

As can be seen from FIG. 2, the support structure 6 extending transversely above web 10 includes two box-like sections 17, 18, which have u-shaped cross sections having an open longitudinal side and are placed back to back. The runoff surface 1 is disposed in front of the open side of box section 18. Extending through the other box-section 17 are two feed channels 19, 20 for supplying the fluid dye to the nozzles. The channels 19, 20 have a cross-section that narrows lengthwise from its distal ends toward the middle of the section 17 such that a constant pressure will be maintained during flow therethrough. The feed channels 19, 20 may be designed as rectangular hollow sections having horizontal top sides upon which fluid connections 21, 22 are distributed in rows parallel to the width of web 1. Feed lines 23, 24, which may be in the form of flexible tubes, originate from connections 21, 22. The middle of tubes 23, 24 are connected to a squeezable tube valve 25, 26 fixedly disposed on the top side of the support structure 6. The squeezed tube valves 25, 26 are operated electromagnetically via control lines 27, whose signals originate from a channel-like control section 28. The tube conduits 23, 24 may be pinched by the valves 25, 26, as needed, to close the conduits. After passage through the valves 25, 26, the tube conduits 23, 24 extend downward in the manner evident from FIG. 2 and are connected to the nozzles 9, 11.

Under the upper wall of box-section 18, i.e. spaced above the run-off surface 1, hinge-type pivot bearings 29, 30 are provided having axes of rotation extending transverse to the running direction of the web 10. Suspended beneath the pivot bearings 29, 30 are rectangular sections 31, 32, which also extend across the width of the web and form elongate support members for the nozzles. Tine-like bars 33, 34 formed of steel strips extend downwardly from sections 31, 32. Nozzles 9, 11 are mounted at the lower free ends of bars 33, 34. At each section 31, 32, as many bars 33, 34 are provided as there are nozzles 9, 11. The sections 31, 32, bars 33, 34, and the nozzles 9, 11 form structural units, which may pivot via bearings 29, 30 about transverse axes and are referred to as "nozzle combs" 7, 8. Nozzle combs 7, 8 are pivoted by drives 35, 36, which may be designed as pneumatic cylinders, connected between the support structure and the nozzle combs. The significance of the pivoting of the nozzle combs 7, 8 is explained in the discussion of FIG. 3 below.

As can be seen from FIG. 2, the inclined run-off surface 1 extends in a planar zone 37. In planar zone 39 next to planar zone 37, run-off gutter 40 is provided adjacent to, and at the level of, the upper zone 38 of the run-off surface 1. Run-off gutter 40 extends over the width of the web 10 to catch fluid dye, which then can be discharged, filtered, and again conveyed to the feed channels 19, 20.

Figure 3:
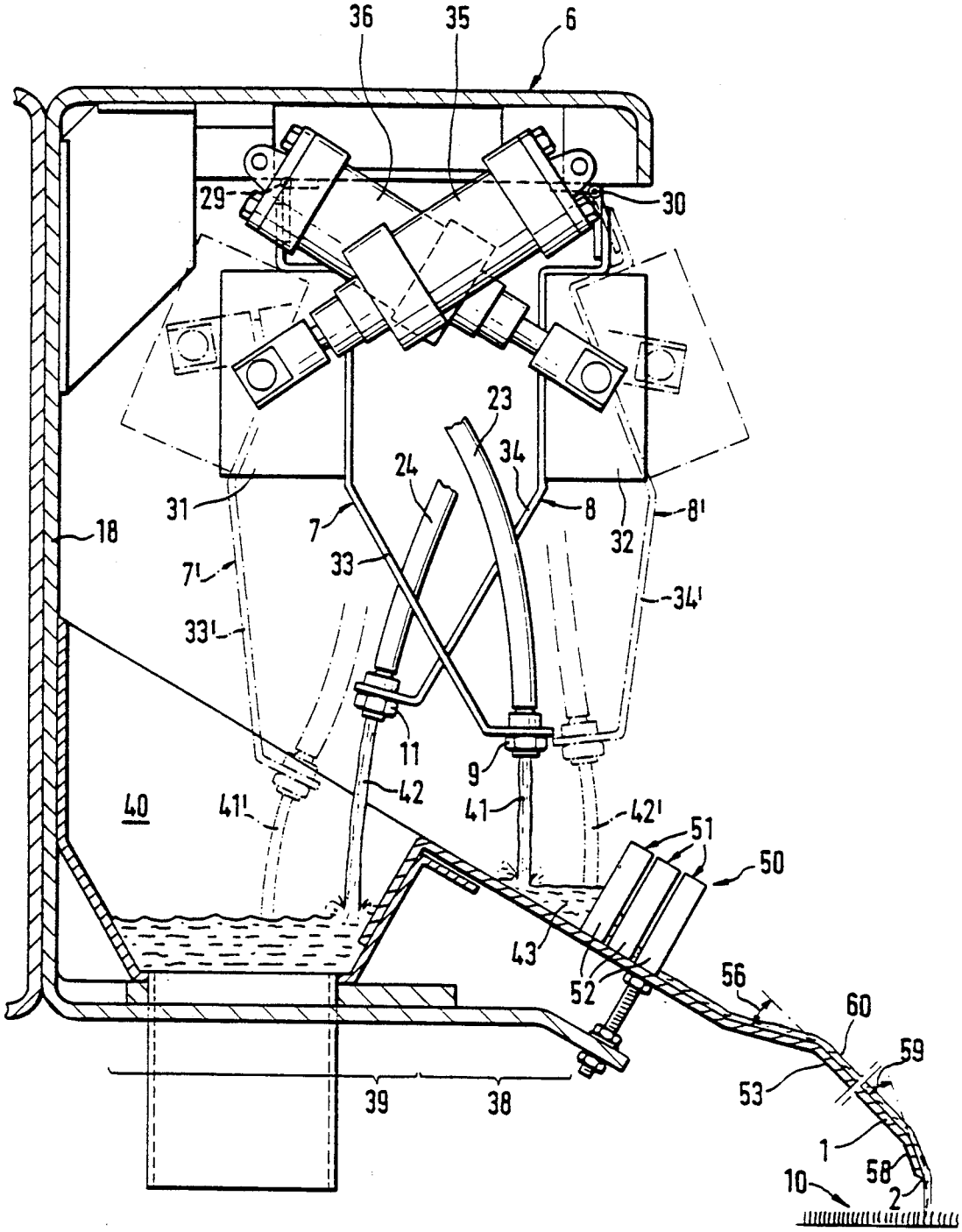
FIG. 3 is a detail of the apparatus of FIG. 1, shown on a larger scale, in which various positions of the nozzle combs are indicated.

The function of the run-off gutter 40 is evident from FIG. 3. In the position of the nozzle comb 7 shown therein in solid lines, nozzles 9 are located above the upper zone 38 of the run-off surface 1 such that fluid dye is directed from nozzles 9 in the form of jets 41 onto the upper zone 38 of the run-off surface 1, where it flows over the latter. The nozzles 11 of the nozzle comb 8, on the contrary, are located, in the position shown in solid lines, over the run-off gutter 40 such that the jets 42' of fluid dye sprayed therefrom are discharged into gutter 40. If it is desired to change the fluid dye that is being applied to the web via run-off surface 1 from that sprayed from nozzles 9 to the fluid dye sprayed from the nozzles 11, nozzle comb 7 is pivoted into the position 7' shown in FIG. 3 in dashed lines. In this position, the fluid dye jets 41' now flow into the run-off gutter 40. As soon as the nozzles 9 have left zone 38 and have passed into zone 39, fluid dye from the nozzles 9 no longer flows onto the run-off surface 1. If desired, the nozzle comb 8 now can be pivoted from its solid-line position into the dashed position 8' such that the fluid dye jets 42 previously flowing into the run-off gutter are now applied onto the run-off surface 1 (42'). In practice, the change-over can take place abruptly and a special advantage is attained in that steady state conditions have been established in the nozzle 11 while the fluid dye jets 42 have been discharging into the run-off gutter 40. Therefore, it is not necessary to wait a predetermined start-up time for possible pressure compensation or the like before application.

Below the upper zone 38 of the run-off surface 1, a flow homogenizing baffle 50 may be provided. The baffle 50 and other aspects of the apparatus are described in more detail in copending application Ser. No. 525,232, filed herewith and entitled Apparatus For Applying A Treatment Fluid Having A Flow Homogenizing Baffle, the disclosure of which is incorporated by reference herein. Baffle 50 is formed of three rows of deflecting elements 51, extending transverse over the width of the web. Elements 51 are disposed close together and have a rectangular cross-sectional shape formed by segments 52, whose sides are about 10 mm and whose height or depth is about 40 mm. Edges of the segments extend horizontally, i.e., perpendicular to the line of fall of the dye flowing down the run-off surface, and parallel to the fall line. The deflecting elements 51 are spaced from one another, both in the transverse or horizontal direction and in the line of fall, a distance of about 1 mm. It is important that the gaps between transversely adjacent deflecting elements 51 are offset—in a row following in the fall line relative to the respective gaps in the preceding row, so that the fluid dye cannot flow directly down the fall line, but is repeatedly deflected by 90° (degrees). The repeated deflection during flow through the flow homogenizing baffle 50 causes a homogenization of the flowing fluid dye film.

The nozzles 9 and 11 are spaced from one another in the transverse direction of the web 10 by a distance of about 50 mm, which is the minimum to accommodate the space requirements of the squeezed tube valves 25, 26. Hence, the fluid dye flows onto the upper zone 38 of the run-off surface 1 at individual points, which are spaced from each other by a considerable distance in transverse direction of web 10.

Above the homogenizing baffle 50 in the upper region of run-off surface 1, a dike 43 of fluid dye flowing from the nozzles 9, 11 forms because of deceleration of the fluid run-off as it flows through a plurality of relatively narrow gaps in the homogenizing baffle 50. The dike equalizes the flow from the individual nozzles in the transverse direction and constitutes a fluid reserve of uniform level. The fluid dye emerges at the lower end of the homogenizing baffle at a multiple of fluid outlets (compared with the number of fluid jets 41 or 42' spaced 50 mm apart) as the distances between these outlets are formed by gaps between the deflection elements 51, which may only be spaced apart from each other at a distance of about 11 mm. In this example, therefore, the fluid dye is distributed over four to five times as many outlets, which although spaced closely together, no longer produce any disturbing irregularities as the fluid dye film flows off over the run-off surface 1.

Below the homogenizing baffle 50, the run-off surface 1 has a slight upwardly, protruding bend that forms an angle 56 of about 30° (degrees), which may be filled with the fluid dye. Tests have shown that this bend once more smooths out the fluid film 60. In addition, the bend serves to stabilize the run-off surface 1. The downwardly directed edge bend 58, which follows in flow direction, also forms an angle 59 of about 30° (degrees) and ends at the lower edge 2, which is sharpened toward the fluid film.

As can be seen from FIG. 4, the bars 33 and 34 of the two nozzle combs 7, 8, which form the "comb tines", are offset relative to each other in transverse direction of web 10 in such a way that one bar 33 of nozzle comb 7 and its corresponding nozzle 9 always is followed by a bar 34 of the nozzle comb 8 and its respective nozzle 11. The spacing of the bars 33 and 34 in transverse direction is chosen so that during the pivoting motion described in accordance with FIG. 3, the nozzle combs 7, 8 can penetrate through each other and do not hinder their pivotal movement.

As the squeezed tube valves 25, 26 can be separately actuated, the web 10 also can be patterned, if this actuation is suitably matched with the pivoting of the nozzle combs 7, 8.

What is claimed is:

1. Apparatus for applying a treatment fluid onto a web of material comprising:

a support structure;

a run-off member connected to said support structure in a position allowing a web of material to be treated in the apparatus to pass underneath said run-off member, said run-off member having upper and lower horizontal edges extending transverse to a web to be treated by the apparatus and defining ends of a substantially flat, rectangular run-off surface having an upper portion and lower portion, said run-off surface sloping downwardly such that said lower horizontal edge is situated directly above a web to be treated by the apparatus when such a web passes underneath the run-off member;

a plurality of nozzles distributed in a direction transverse to a web to be treated by the apparatus, said nozzles being carried by said support structure so as to be located in a first position above the upper portion of the run-off surface whereby treatment fluid conducted to said nozzles can be applied onto the upper portion of the run-off surface;

means supporting at least one of said plurality of nozzles for movement away from said run-off surface to a second position in which treatment fluid conducted to said at least one nozzle is directed away from said run-off surface; and means supporting at least one of said plurality of nozzles for movement away from said run-off surface to a second position in which treatment fluid conducted to said at least one nozzle is directed away from said run-off surface; and means for moving said at least one of said plurality of nozzles while treatment fluid is being conducted to said nozzles.

2. Apparatus according to claim 1, wherein said supporting means includes means supporting said at least one nozzle for pivotal movement about an axis extending above said at least one nozzle in a direction transverse to a web to be treated by the apparatus.

3. Apparatus according to claim 1, further comprising a run-off gutter extending adjacent and parallel to the upper horizontal edge of the run-off surface and wherein the second position of said at least one nozzle is located above said run-off gutter whereby treatment fluid sprayed from said at least nozzle in at least the second position of said at least one nozzle is collected in the run-off gutter.

4. Apparatus according to claim 1, wherein said at least one nozzle comprises at least two groups of nozzles and said supporting means includes means supporting each group of nozzles for movement away from the run-off surface independent of the other group.

5. Apparatus according to claim 4, wherein the nozzles are distributed in a direction transverse to a web to be treated by the apparatus such that the nozzles of one of said groups alternate with nozzles of another of said groups.

6. Apparatus according to claim 5, further comprising means for supplying the nozzles of said one group with treatment fluid separate from means for supplying the nozzles of said another group with treatment fluid.

7. Apparatus according to claim 4, wherein each group of nozzles comprises a pivotable nozzle comb formed by an elongate support member having a longitudinal axis extending in a direction transverse to a web to be treated in the apparatus, a plurality of comb tines downwardly depending from said elongate support member at spaced intervals along the length of said support member, each tine having a free end distal from said elongate support member upon which one of said plurality of nozzles is mounted, and said supporting means comprises a bearing provided for each nozzle comb, said bearing being coupled between said elongate support member and said support structure and having a pivot axis extending above said elongate support member in a direction transverse to a web to be treated in the apparatus.

8. Apparatus according to claim 7, further comprising means for pivoting the nozzle combs independently of each other and wherein the nozzle combs are arranged such that the comb tines of each group pass through the comb tines of another group unhindered during pivotal movement of one or more nozzle combs between the first and second positions.

9. Apparatus according to claim 1, further comprising means for separately supplying groups of nozzles with treatment fluid.

10. Apparatus according to claim 9, wherein said separate fluid supplying means comprises a separately controllable valve associated with each group of nozzles for controlling the flow of treatment fluid thereto, said valves being fixedly supported in the apparatus in a position above the nozzles and being connected to their associated group of nozzles via flexible conduits.

11. Apparatus according to claim 10, wherein said valves comprise squeezed tube valves.

12. Apparatus according to claim 1, further comprising a flow homogenizing baffle provided on the run-off surface between the upper and lower portions thereof, said baffle extending horizontally over the run-off surface and including a number of fluid inlets and fluid outlets communicating with tortuous channels disposed in said baffle whereby fluid jets sprayed from the nozzles onto the upper portion of the runoff surface are divided into smaller fluid streams exiting the baffle at the fluid outlets such that the fluid streams converge to form a film of uniform thickness flowing over the lower portion of the run-off surface.

13. Apparatus according to claim 1, wherein said at least one nozzle is less than all of said nozzles.

14. Apparatus for applying a treatment fluid onto a web of material comprising:

a support structure;

a run-off member connected to said support structure in a position allowing a web of material to be treated in the apparatus to pass underneath said run-off member, said run-off member having upper and lower horizontal edges extending transverse to a web to be treated by the apparatus and defining ends of a substantially flat, rectangular run-off surface sloping downwardly such that said lower horizontal edge is situated directly above a web to be treated by the apparatus when such a web passes underneath the run-off member;

a plurality of nozzles distributed in a direction transverse to a web to be treated by the apparatus, said nozzles being carried by said support structure so as to be located in a first position above the upper portion of the run-off surface whereby treatment fluid conducted to said nozzles can be applied onto the upper portion of the run-off surface; and means pivotably supporting at least one of said plurality of nozzles for movement away from said run-off surface to a second position in which treatment fluid conducted to said at least one nozzle is directed away from said run-off surface.

15. Apparatus according to claim 14, wherein said at least one nozzle is less than all of said nozzles.

* * * * *